United States Patent [19]

Sorensen

[11] 4,253,321

[45] Mar. 3, 1981

[54] KEY HOLDER

[76] Inventor: Peter H. Sorensen, 189-18 35th Ave., Flushing, N.Y. 11358

[21] Appl. No.: 77,510

[22] Filed: Sep. 21, 1979

[51] Int. Cl.[3] ..... A47G 29/10

[52] U.S. Cl. ..... 70/456 R

[58] Field of Search ..... 70/456 R, 456 B, 459; 150/40; 24/3 K

[56] References Cited

U.S. PATENT DOCUMENTS

| | | | |
|---|---|---|---|
| 1,974,558 | 9/1934 | Andis | 70/456 R |
| 2,540,819 | 2/1951 | Glass | 70/456 R |
| 2,753,710 | 7/1956 | Bestard | 70/456 R |
| 3,436,942 | 4/1969 | Proctor | 70/456 R |

*Primary Examiner*—Robert L. Wolfe

*Attorney, Agent, or Firm*—Allison C. Collard; Thomas M. Galgano

[57] ABSTRACT

A key holder is provided which includes a plurality of resilient, generally S-shaped key partitions arranged in a pack and generally disposed in spaced-apart, parallel relationship. Each of the partitions having two opposite end portions which are joined together by a sloping intermediate portion, and the end portions of adjacent partitions defining key head-receiving slots therebetween. A plurality of partition spacers are also provided, each of which is disposed solely between the intermediate portions of an adjacent pair of the partitions. The key holder also includes a pair of generally S-shaped side plates, each of which is disposed on an opposite side of the pack of partitions. Each of the side plates have two opposite end portions which are joined together by a sloping intermediate portion, which are in substantial alignment with the end and intermediate portions of the partitions. The intermediate portions of the side plates extend laterally outward beyond the lateral sides of the intermediate portions of the partitions so as to define uninterrupted key bit-receiving channels on either lateral side of the intermediate portions of the partitions. The key heads of a plurality of keys are demountably and pivotably secured in the key slots under adjustable frictional tension so as to permit the keys to be individually pivoted between a non-operative position, in which the key bit thereof lies within the uninterrupted key bit-receiving channel, and an operative position, in which the key bit is pivoted completely out of the channel.

7 Claims, 5 Drawing Figures

KEY HOLDER

The present invention relates to a key holder adapted to conveniently retain a plurality of keys of different shapes and dimensions and to permit ready and facile selection of one of the keys for use.

Various types of key holders are, of course, well known in the art. For example, there are a number of key holders (see U.S. Pat. Nos.: 1,911,261; 1,943,844; 2,047,331; 2,560,595; 2,753,710; 3,321,943; and 3,354,679) which typically include a housing or support which consists of a number of fixed key partitions between which each of the keys are mounted. Some of these key holders are provided with spring-loaded activation devices or buttons for removing a particular key from the holder.

These types of key holders have been found to be disadvantageous for a number of reasons. In particular, those with fixed key partitions, do not afford a versatility with respect to the number of keys which may be held by the key holder. In addition, the employment of fixed partitions or dividers, particularly in the area of the key bits or shanks prevents the key holder from retaining "non-normal" or somewhat larger or uniquely configured keys. Moreover, key holders with fixed dividers typically do not permit proper adjustment of the frictional tension applied on the keys so as to ensure that the keys may be selectively removed from the key holder. Furthermore, those with spring-loaded buttons tend to require a more complicated construction, and high costs without significantly improving ease of operation.

Accordingly, it is an object of the present invention to provide a novel key holder which is adapted to retain a plurality of keys of different shapes and dimensions and which permits ready and facile selection of a particular key for use.

It is a further object of the present invention to provide a novel key holder which permits adjustment of the frictional tension applied to the keys.

It is another object of the present invention to provide a novel key holder having the foregoing attributes and characteristics which is relatively simple in design, low in cost to produce, durable and reliable in use.

Certain of the foregoing and related objects are readily attained in a key holder which includes a plurality of resilient, generally S-shaped key partitions arranged in a pack and generally disposed in spaced-apart, parallel relationship. Each of the partitions has two opposite end portions terminating in opposite directions which are joined together by a sloping intermediate portion, and the end portions of adjacent partitions define key head-receiving slots therebetween. A plurality of partition spacers are each disposed solely between the intermediate portions of an adjacent pair of the partitions. The key holder also includes a pair of generally S-shaped side plates, each of which is disposed on an opposite side of the pack of partitions. Each of the side plates has two opposite end portions terminating in opposite directions which are joined together by a sloping intermediate portion. The end and intermediate portions of the side plates are in substantial alignment with the end and intermediate portions of the partitions, and the intermediate portions of the side plates extend laterally outwardly beyond the lateral sides of the intermediate portions of the partitions so as to define uninterrupted key bit-receiving channels on either lateral side of the intermediate portions of the partitions.

Means are also provided for demountably and pivotably securing the key heads of a plurality of keys in the key head slots under adjustable frictional tension. This permits the keys to be individually and selectively pivoted under the desired degree of frictional tension between a non-operative position, in which the key bit thereof lies within the uninterrupted key bit-receiving channel, and an operative position, in which the key bit is pivoted completely out of the channel.

Preferably, the end portions of the partitions and at least one of the side plates each have a mounting hole formed therethrough and the means for demountably and pivotably securing comprises a bolt having a bolt head and an at least partially threaded bolt shank which is received through the mountings holes of one of the end portions of the partitions and the side plate and a thread-receiving member formed in the other side plate in which the bolt shank is receivable to adjust the frictional tension applied to key heads received in the key slots. Most desirably, the thread-receiving member comprises an internally threaded bore formed on the end portions of one of the side plates. The bolt heads preferably have a ring pivotably secured thereto so as to assist the tightening and loosening thereof.

In a preferred embodiment, the key holder additionally includes at least one key head spacer pivotably mounted between a pair of adjacent end portions for movement into and out of the key head slot defined by the end portions. Most advantageously, the key head spacer is pivotably mounted on a generally rectangular mounting clip secured to one of the end portions of the partitions and side plates. Most desirably, a key clip is received on the mounting clip and has a thumb grip received thereon. It is also preferable to have a pair of identification plates secured to the outer surfaces of one of the end portions of the side plates.

Other objects and features of the present invention will become apparent from the following detailed description, considered in connection with the accompanying drawing, which discloses a single embodiment of the invention. It is to be understood, however, that the drawing is designed for the purpose of illustration only, and not as a definition of the limits of the invention.

In the drawing, wherein similar reference characters denote similar elements throughout the several views.

Figure 1:
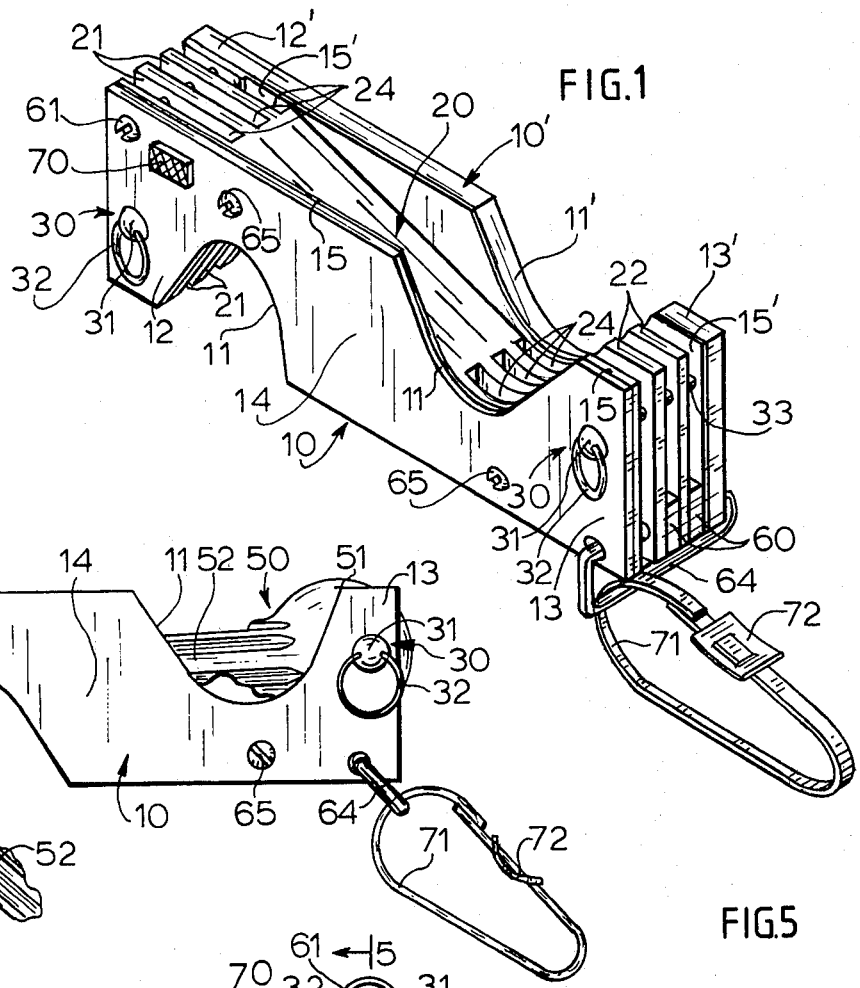
FIG. 1 is a top, front and side perspective view of a novel key holder embodying the present invention.
Figure 3:
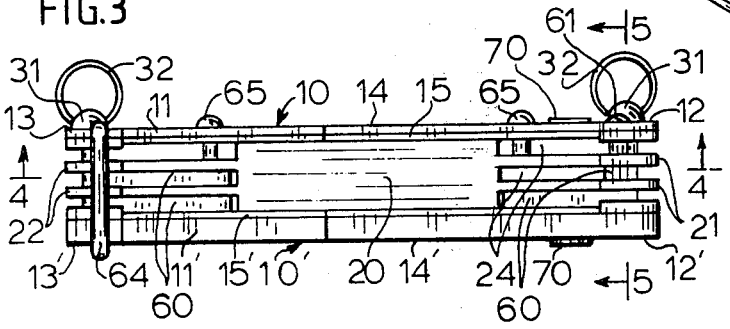
FIG. 3 is a bottom view of the key holder.

Turning now in detail to the drawing, and in particular FIG. 1 thereof, therein illustrated is a novel key holder embodying the present invention which includes a pair of generally rectangular side plates 10, 10', each of which have a pair of arcuately-shaped notches 11,11' formed in the upper and lower edges thereof so as to impart to side plates 10, 10' a generally S-shaped configuration defined by opposite end portions 12, 12' and 13, 13' and an intermediate portion 14, 14'. Side plates 10,10' are preferably made from relatively rigid metal. Affixed to the inner lateral surfaces of side plates 10, 10' are plastic side plate spacers 15, 15' which, as shown in FIG. 3, have a greater width in the area of end portions 12, 12' and 13, 13' to allow for greater key spacing.

Figure 4:
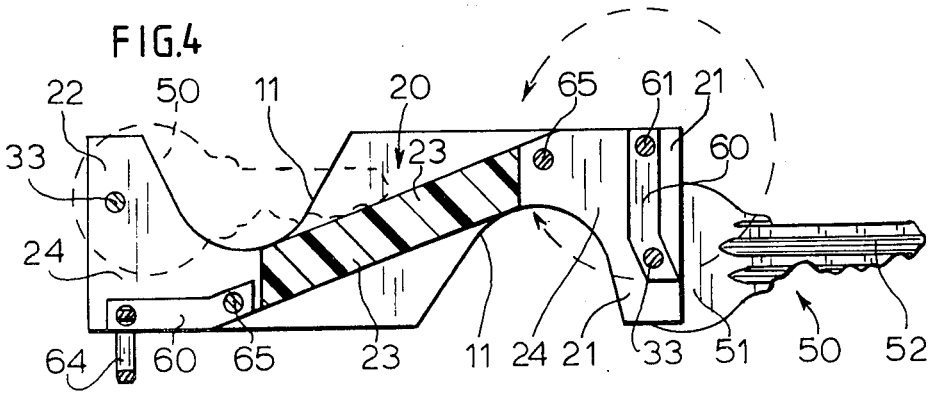
FIG. 4 is a sectional view taken along line 4—4 of FIG. 3, further showing two keys (one in solid line and one in phantom line) mounted thereon.

Sandwiched between side plates 10, 10' and side plate spacers 15, 15' is a key partition frame 20 which, as shown best in FIG. 4, also has a generally S-shaped configuration defined by two end portions 21, 22 which are disposed generally parallel to one another and are joined by a sloping intermediate portion 23. As seen in FIGS. 1 and 3, intermediate portion 23 is solid but end portions 21 and 22 are slotted so that each define three key head-receiving slots 24 (slots 24 are defined by two resilient arms 21, 22, in combination with side plate spacers 15, 15' in actuality).

Figure 5:
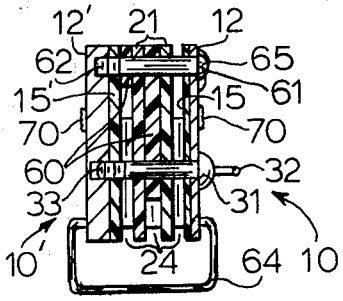
FIG. 5 is a sectional view taken along line 5—5 of FIG. 3.

A pair of mounting bolts 30 having a rounded head 31 to which a finger grip ring 32 is pivotably attached and a partially threaded stem 33 are each received in one of a pair of laterally-extending bores formed in the end portions 12, 13 of the side plate 10, which bores extend through side plate spacers 15, 15' and key partition frame 20. These bores each lead to an internally threaded bore in rear side plate 10' in which the threaded end of stem 33 can be screwed or unscrewed, as can be seen best in FIG. 5.

Figure 2:
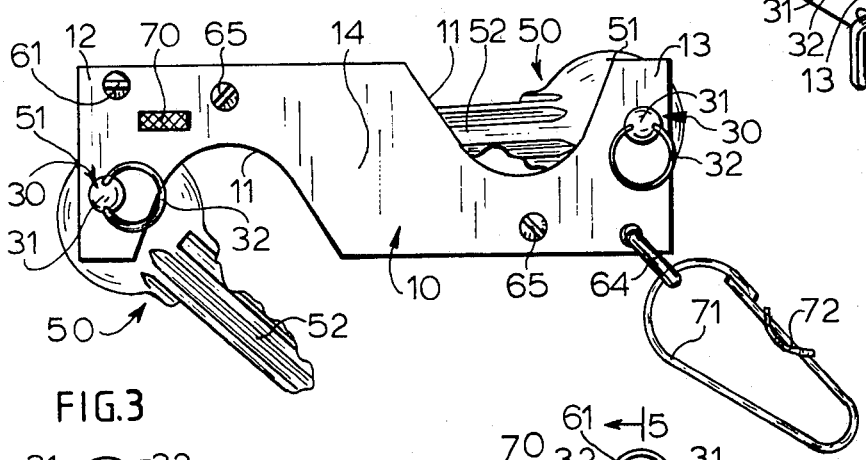
FIG. 2 is a side view of the key holder shown in FIG. 1, further showing two keys mounted therein.

As shown in FIGS. 2 and 4, the keys 50 which are retained by the key holder are pivotably mounted on mounting bolts 30 with their key heads 51 disposed substantially within the key-head receiving slots 24. When in a retracted position (as shown in phantom line in FIG. 4), the key shank lies within an uninterrupted channel defined by the upper and lower surfaces of the intermediate portion 23 of partition frame 20 and the intermediate wall portions of side plate 10, 10'. Due to this unencumbered channel, keys having key shanks of relatively greater width may be retained without the necessity for increasing the overall dimensions of slots 24 or the distances therebetween and without getting stuck as might be the case where continuous fixed key partitions or vertical dividers are employed.

As can be readily appreciated, in order to insert the keys onto the key holder, the heads 51 would be inserted into slots 24 with their key holes (not shown) aligned with the bores for mounting bolts 30. Mounting bolt 30 would then be inserted therethrough with all of the keys in place in slots 24. Bolts 30 would then be tightened until there was sufficient frictional pressure applied to key heads 50 to prevent their undesired pivoting and withdrawal of bits 52 from the key holder channel. At the same time, the bolts should not be adjusted too tight but just enough to permit the selective withdrawal of a key. The adjustment of the tension or frictional resistance is assisted by the resiliency of arms 21, 22.

In case not all of the key slots are used, key slot spacers 60 are employed to maintain the proper positioning of arms 21, 22 and to also prevent undesirable twisting of the key holder upon tightening of mounting bolts 30. As seen in FIG. 4, at least one of the slots 24 on each end is provided with a key spacer 60. One or more of these spacers are mounted on a bolt 61 which, like bolt 30 is received through side plate 10, side plate spacer 15, 15' and the end portions of key partition frame 20 and is threaded into a thread bore formed in side plate 10' (see FIG. 5). Alternatively, these spacers could be mounted on a key clip 64 as shown in the left-hand end of the key holder in FIG. 4.

As further shown in FIG. 4, when a key 50 (in phantome line) is received in the slot, key spacer 60 is maintained in an inoperative position in which it is disposed in a generally horizontal position. A further mounting bolt 65 is provided for securing key spacer 60 in this position. Alternatively, key spacer 60 may be pivoted to assume a substantially vertical position as shown at the right hand end of FIG. 4. In this position, mounting bolt 32 would be used to secure its free end. As a result of the employment of these spacers as "substitute keys", a twisting or bending of the key holder and the resilient elements thereof will be significantly minimized. This also facilitates comparably equal tightening of both ends of the key holder.

As shown in FIGS. 1 and 3, the key holder is also provided with a pair of rectangular embossments 70, one on each of the end portions 12, 12' so as to permit the user to manually determine which way he is holding it. This is quite helpful especially at night when searching for the right key. In addition, a key ring 71 is mounted on key clip 64. Key ring 71 is provided with a thumb grip 72 to facilitate opening thereof.

It should be pointed out that in order to withdraw a key from the key holder the user will typically use his thumb to withdraw the outside key in one easy stroke (by simply placing his thumb into the notched portion 11, 11' and pivoting the key approximately 180°). The inwardly disposed keys will require some slight finger and key manipulation but this is still an extremely simple and facile procedure due to the proper adjustment of tension and the resultant ease with which the keys may be selectively moved.

It is expected that the key holder will be adapted to accommodate a total of 4–6 or 6–8 keys. For the latter case, the relatively small outside dimensions of approximately $100\times30\times16$ mm for the key holder has been found to be quite suitable.

It should be noted that many changes and modifications may be made as will be apparent to those skilled in the art. For example, the dimensions, number of key slots, etc. may be modified depending on ones particular needs. In addition, although the key partition frame has been shown as one integral element, it may consist of relatively long, separate key slot forming partitions or plates separated by separate shorter plate dividers so as to permit easy removal or addition of key partitions according to the number of keys employed.

Thus, while only a single embodiment of the present invention has been shown and described, it will be obvious that many modifications and changes may be made thereinunto, without departing from the spirit and scope of the invention.

What is claimed is:

1. A key holder comprising:

a plurality of resilient, generally S-shaped key partitions arranged in a pack and generally disposed in spaced-apart, parallel relationship, each of said partitions having two opposite end portions terminating in opposite directions which are joined together by a sloping intermediate portion, said end portions of adjacent partitions defining key head-receiving slots therebetween;

a plurality of partition spacers, each of which is disposed solely between the intermediate portions of an adjacent pair of said partitions;

a pair of generally S-shaped side plates, each of which is disposed on an opposite side of said pack of partitions, each of said side plates having two opposite end portions terminating in opposite directions which are joined together by a sloping intermediate portion, said end and intermediate portions of said side plates being in substantial alignment with said end and intermediate portions of said partitions, and said intermediate portions of said side plates extending laterally outward beyond the lateral sides of the intermediate portions of said partitions so as to define uninterrupted key bit-receiving channels on either lateral side of said intermediate portions of said partitions;

means for demountably and pivotably securing the key heads of a plurality of keys in said key slots under adjustable frictional tension so as to permit said keys to be individually pivoted under the desired degree of frictional tension between a non-operative position, in which the key bit thereof lies within said uninterrupted key bit-receiving channel, and an operative position, in which said key bit is pivoted completely out of said channel.

2. The key holder according to claim 1, wherein said end portions of said partitions and at least one of said side plates, each have a mounting hole formed therethrough and wherein said means for demountably and pivotably securing comprises a bolt having a bolt head and an at least partially threaded bolt shank which is received through each of said mounting holes of one of said end portions of said partitions and side plate and a thread-receiving member in which said shank is receivable so as to adjust the frictional tension applied to the key heads received in said key slots.

3. The keyholder according to claim 2, wherein said thread-receiving member comprises an internally-threaded bore formed on the end portions of one of said side plates and wherein said bolt heads have a ring pivotably secured thereto so as to assist in the tightening and loosening thereof.

4. The key holder according to claim 1, additionally including at least one key head spacer pivotably mounted between a pair of adjacent end portions for movement into and out of the key head slot defined by said end portions.

5. The key holder according to claim 1, wherein said key head spacer is pivotably mounted on a generally rectangular mounting clip secured to one of said end portions of said partitions and side plates.

6. The key holder according to claim 5, additionally including a key clip received on said mounting clip having a thumb grip received thereon.

7. The key holder according to claim 1, additionally including a pair of embossment plates secured to the outer surfaces of one of the end portions of said side plates.

* * * * *